United States Patent [19]

Struben et al.

[11] 4,285,175

[45] Aug. 25, 1981

[54] THERMALIZED AWNING

[76] Inventors: Francis L. Struben; Jean C. Struben, both of 3870 Jarrettsville Pike, Jarrettsville, Md. 21084

[21] Appl. No.: 67,403

[22] Filed: Aug. 17, 1979

[51] Int. Cl.[3] ..... E04D 3/24; E04D 3/35; E04F 10/00

[52] U.S. Cl. ..... 52/90; 52/74; 52/96; 52/263; 52/407; 52/408; 52/639; 52/814; 52/DIG. 15

[58] Field of Search ..... 52/74, 22, 90–94, 52/58, 75, 76, 77, 78, 404, 287, 288, 16, 73, 263, 479, 643, 96, 814, DIG. 15, 407, 408, 639

[56] References Cited

U.S. PATENT DOCUMENTS

| | | | |
|---|---|---|---|
| 1,682,291 | 8/1928 | Lane | 52/22 |
| 2,799,232 | 7/1957 | Jaeger | 52/409 |
| 2,957,483 | 10/1960 | Dunn | 52/74 |
| 3,084,479 | 4/1963 | Struben | 52/478 |
| 3,100,012 | 8/1963 | Dunn | 52/90 |
| 3,994,104 | 11/1976 | Gurrola | 52/22 |

FOREIGN PATENT DOCUMENTS

| | | | |
|---|---|---|---|
| 1028906 | 5/1966 | United Kingdom | 52/90 |

*Primary Examiner*—John E. Murtagh
*Attorney, Agent, or Firm*—Walter G. Finch

[57] ABSTRACT

The invention is an improved awning used on homes, mobile homes, and modular homes, where the area under the awning may be subsequently converted into an additional room. The structure provides a rigid insulating panel between the roofing material panels and the supporting framework to reduce the conduction of temperature extremes and the elimination of condensation on the inside surface of supporting framework.

3 Claims, 4 Drawing Figures

THERMALIZED AWNING

BACKGROUND AND SUMMARY OF THE INVENTION

The invention relates to awnings used to cover areas adjacent to building structures, such as porch areas, patios and the like, and in particular to awnings usually made of metal and mounted on metal framework structures. Specifically, the invention relates to such awning structures as may be subsequently converted to an enclosed area to provide an additional room or rooms for the building structure to which attached.

This type of awning is often used in conjunction with homes, mobile-type homes, or modular homes. It is to be understood that the use of this type of awning is not limited to that type of structure, but may be used on any type of building for other uses.

In the prior art, as for example, the trailer or mobile home awning of U.S. Pat. No. 3,084,479, invented by one of the present co-inventors, corrugated type roofing panels were directly connected to the metal supporting framework structure. This structure resulted in problems, especially when the area was later converted into a room or rooms by enclosing the open ends and side.

In extremely high temperatures, the heat was conducted into the interior of the enclosed area by direct conduction transmittal. The high temperatures established on the outside surface of the roofing panels was conducted to the interior through the metal roof trusses as if the exposed lower surface of the roof trusses were each on elongated radiator. Suspended insulation panels between trusses, usually resting on the upper surface of the lower chord of the roof trusses, was no barrier to the direct conduction through the truss member.

In a like manner, in extremely cold temperatures the cold was conducted into the interior of the enclosed area by direct conduction transmittal. The cold temperatures established on the outside surface of the roofing panels was conducted to the interior through the metal roof trusses as if the exposed lower surface of the roof trusses were each an elongated refrigeration line. Condensation of the moist interior air appears along each roof truss lower surface and drips to the floor. The use of suspended insulation panels between trusses, usually resting on the upper surface of the lower chord of the roof trusses, was no barrier to the direct conduction through the truss member or the condensation on the bottom chord.

An insulator is inserted between the roof panels and the top of the roof truss to interrupt the conduction of high and low temperatures. In addition, the cross sectional contour of the common corrugated roof panels is changed to facilitate the fastening of the insulator and the fastening of the panels to the roof trusses.

The present invention eliminates the aforementioned problems of temperature extremes by interrupting the conduction of the temperatures as hereinbefore described.

It is therefore, an object of the invention to provide a thermalized awning structure to interrupt the conduction of high temperatures from exterior roof panels to the interior lower chord of the awning roof trusses.

It is another object of the invention to provide a thermalized awning structure to interrupt the conduction of low temperatures from exterior roof panels to the interior lower chord of the awning roof truss.

It is also an object of the invention to provide a thermalized awning structure to prevent condensation at the lower chord of the awning structure when the area under the awning structure is enclosed.

It is still another object of the invention to provide a thermalized awning structure having a roof panel contour that will facilitate fabrication with an insulator.

It is yet another object of the invention to provide a thermalized awning structure having an improved fastening system to the roof trusses and the adjacent structure.

Further objects and advantages of the invention will become apparent in the light of the following description of the preferred embodiments.

DESCRIPTION OF THE PREFERRED EMBODIMENTS

Figure 1:
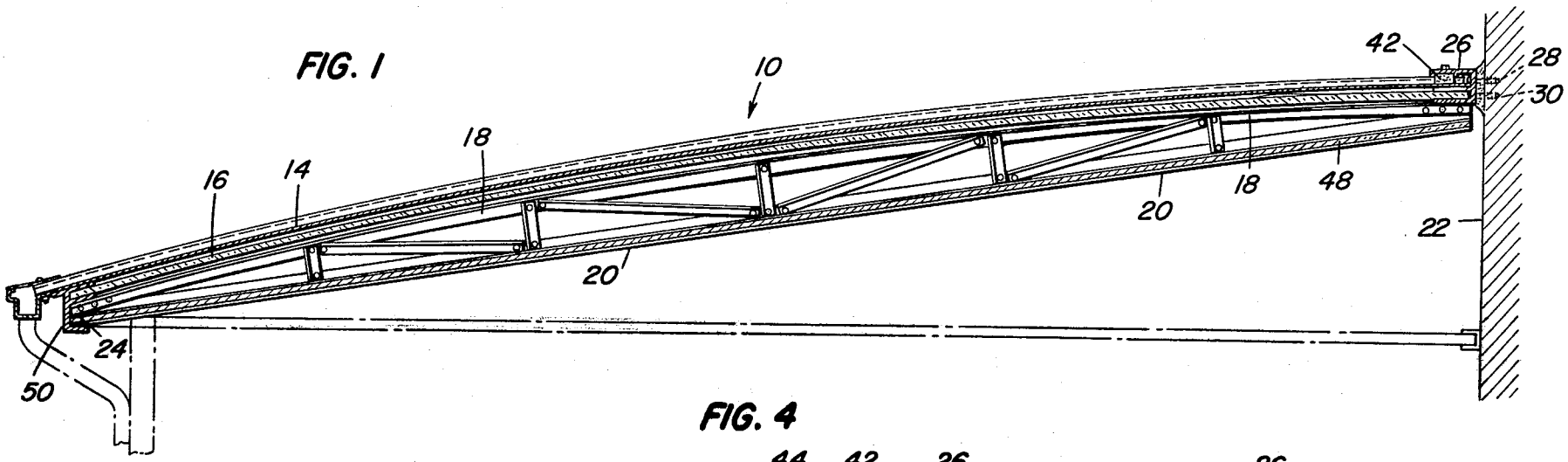
FIG. 1 is a side view of a typical thermalized awning roof truss showing location of insulator in relation to roof panels and roof truss.

Referring to the drawings and particularly to FIG. 1, a thermalized awning is shown at 10. The thermalized awning consists of the framework of roof truss structures 12 spaced apart, the contoured roof panels 14 to cover the framework, and the insulator 16. A plurality of roof truss structures 12, spaced apart, with panels 14 and insulators 16 provides any length thermalized awning 10 required.

The top or upper chord 18 of the roof truss structure 12 is curved to provide strength and to eliminate rattle and noise associated with a flat roof structure which is common in ordinary awnings.

The top chord 18 and the bottom chord 20 being assembled together with struts and ties (not numbered) in truss fashion.

Figure 2:
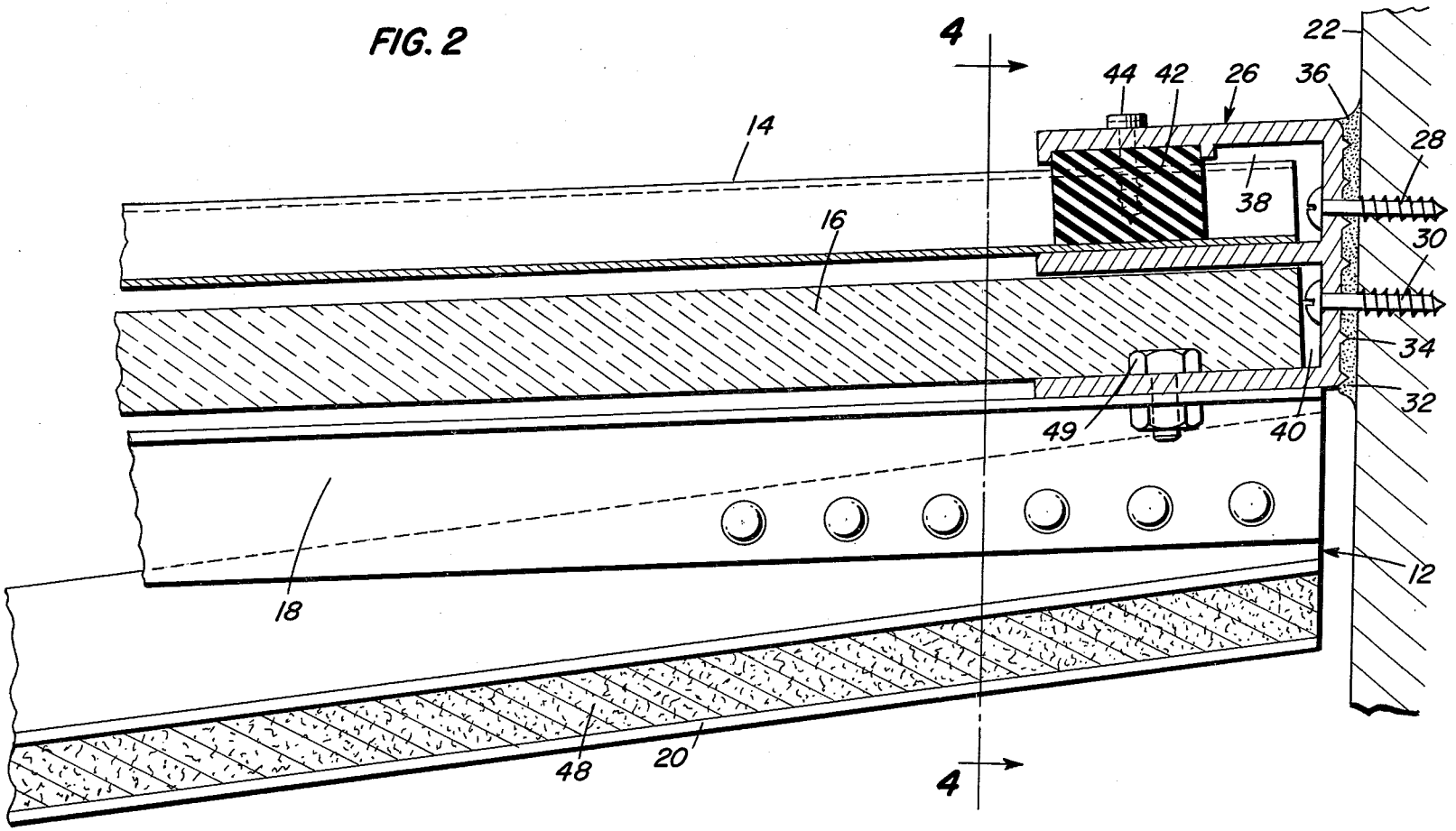
FIG. 2 is an enlarged view of the end of the roof truss at its juncture with an adjacent wall.
Figure 3:
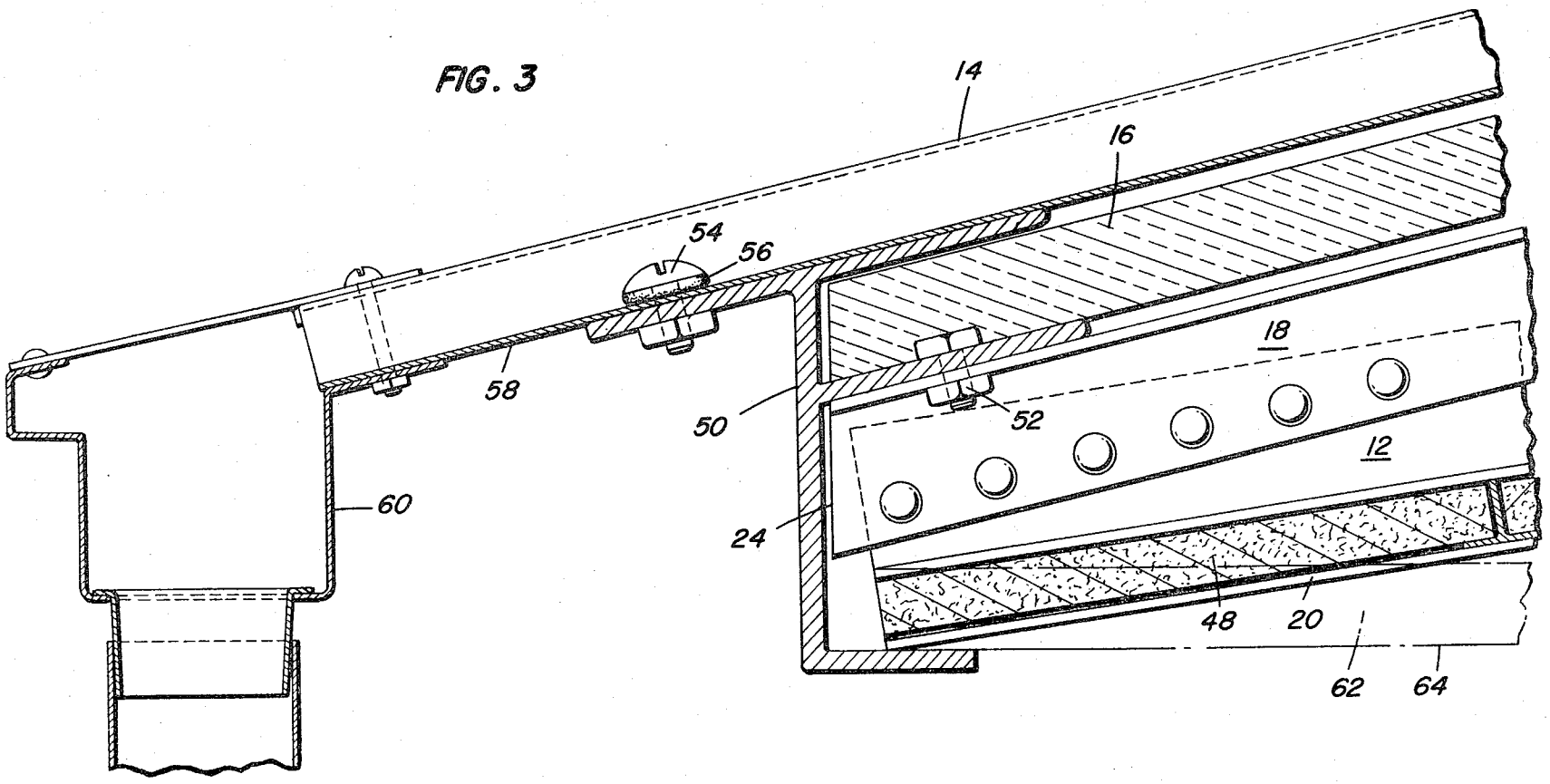
FIG. 3 is an enlarged view of the end of the roof truss at the outboard end.

The bottom or lower chord 20 is shown straight in relation to the upper chord 18 curvature. As set between the wall 22 of the building structure to which the thermalized awning 10 is attached and the outer or outboard end 21 of the roof truss structure 12, the lower chord 20 appears to rise from the outboard end 24 to the wall 22. This is done so that rain will flow away from the wall 22 on the thermalized awning 10; it also eliminates the need for a valley-type gutter at the wall 22, which would be a potential source of leakage and other related problems. Turning now to FIGS. 2 and 3, the detail of the thermalized awning 10 can be seen at the wall 22 end in FIG. 2, and at the outboard end 24 in FIG. 3.

At the wall 22 end in FIG. 2, a special "W" shaped channel 26 is attached to the wall 22 with screws 28 and 30. A caulking compound or caulking tape 32 is inserted between the "W" channel 26 and the wall 22 to seal the connection against leakage. The caulking compound 32 is an adhesive-like material that will adhere to the wall 22 and to the "W" channel 26. A plurality of ribs 34 on the wall 22 side of the "W" channel 26 are forced into the caulking compound 32 as the screws 28 and 30 tighten the "W" channel 26 to the wall 22 to enhance the seal.

It is to be understood that lag screws, bolts, or other means of fastening may be used instead of screws 28 and 30 and such use is within the scope and intent of this invention.

Additional caulking compound 32 may be added at the upper end 36 of the connection as an added seal.

The roof panels 14 are inserted in the upper channel opening 38 of the "W" channel 26. The "W" channel 26 cross section is more like two "U" shaped channels joined together to form the "W" channel 26.

Figure 4:
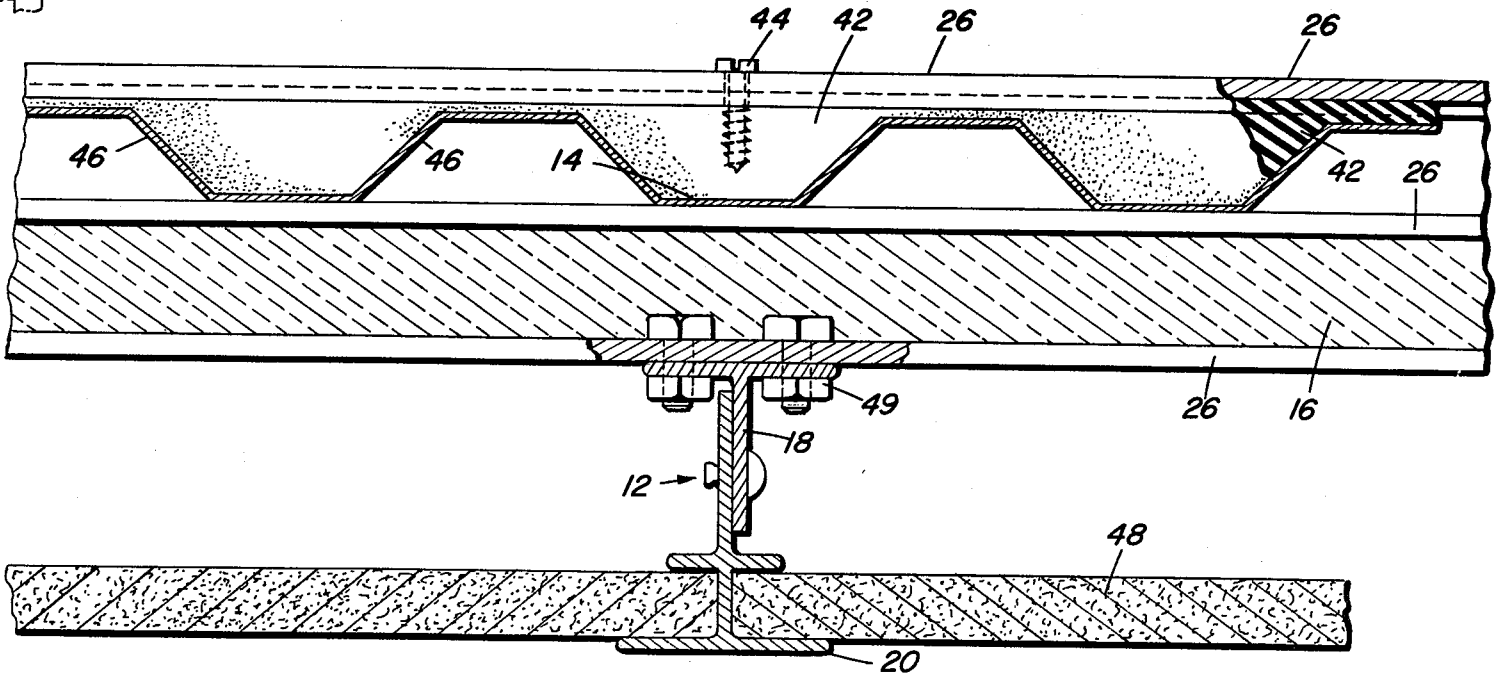
FIG. 4 is a cross section view on line 4—4 of FIG. 2.

A rubber seal 42 is inserted in the contour valleys of the roof panels 14 and held in place by a screw 44 through the "W" channel 26. The relationship of the contoured roof panel 14, the rubber seal 42 and the holding screw 44 can be seen in FIG. 4. The improved flattened hill and valley contour configuration 46 of the roof panels 14 may be seen in FIG. 4. This improves the fabrication and fastening of the panels and reduces possibilities of leakage at the joints and fastener connections in comparison with the commonly used sine-wave corrugated material.

An insulator 16 is inserted in the lower channel opening 40 of the "W" channel 26. Thus, it can be seen that the insulator 16 spaces the roof panels 14 from the roof truss structure 12 to provide the thermalized awning 10. In the prior art, the roof panels 14 were attached directly along the entire length of the upper chord 18 and thus provided a direct path to conduct heat and cold from the outside to the inside, and particularly to and along the lower chord 20 of the roof truss 12.

As shown, there is also some air space between the roof panels 14 and the insulator 16 and between the insulator 16 and the upper chord 18 of the roof truss 12. These are added blocks to the transmission of heat and cold by conduction.

The wall 22 end of the roof truss 12 is attached to the "W" channel 26 by bolt and nut connection 49.

To eliminate leaks, in this improved structure of a thermalized awning there is no "bolt-down" connection between the connection at the wall 22 end and the outboard end 24. It is to be understood, however, that the addition of intermediate fastenings in the roof panels 14 is within the scope and intent of this invention.

It is to be noted in FIG. 2 that the slope of the upper chord 18 of the roof truss 12, although curved, is set so as to slope away from the wall 22 to assure that rain will run off and not back up toward the "W" channel 26 at wall 22.

Likewise it is to be noted in FIG. 2 that the lower chord 20 also slopes away from the wall 22. An interior ceiling panel 48, which may be added for additional insulation, is inserted in between the lower chords 20 of the roof trusses 12. In this respect it provides a sloped ceiling or what may be termed a half-cathedral type ceiling.

Turning now to FIG. 3, an "E" shaped framing member 50 is shown attached to the end of roof truss 12 by bolt and nut connection 52.

The roof panels 14 pass across the top of the "E" member 50 to provide an overhanging eave 58. The roof panels 14 are fastened to the "E" member 50 by bolt and nut 54. A rubber-like washer 56 under the head of the bolt 54 prevents leakage under the eave 58 or seepage along the top of the "E" member 50.

A raingutter 60 is attached to the end of the roof panels 12 and may be so constructed so as to be covered, if desired.

The insulator 16 is inserted in channel portion of the "E" member 50, thus completing the insulation to form the thermalized awning 10.

The lower chord 20 is shown in FIG. 3 in relation to the curved upper chord 18. A horizontal ceiling panel 62 (Shown in dotted lines) is shown set in a special horizontal channel 64 (shown in dotted lines) which attaches to the lower chord 20 when a drop-type horizontal ceiling is desired. At the wall 22 end the channels 64 for such a horizontal ceiling would be attached to wall 22 or held by hangers (not shown) from the wall 22 end of roof truss 12.

Thus, arrangements for either a sloped ceiling (ceiling panel 48) as shown in FIG. 2, or a horizontal ceiling (ceiling panel 62) as shown in FIG. 3, may be used with the thermalized awning 10.

The insulator 16 may be of most any rigid type insulation, such as a foamed plastics or the like.

The outer end or distal end of the thermalized awning 10 from the wall 22 may be supported on a beam or girder on posts, columns, poles, pillars, walls or any other structural means. Such support means in no way alters the aforementioned structure of the thermalized awning 10.

Accordingly, modifications and variations to which the invention is susceptible may be practiced without departing from the scope and intent of the appended claims.

What is claimed is:

1. A thermalized awning, comprising:

a framework, said framework consisting of a plurality of roof truss structures, said roof truss structures being spaced apart and set in an array, each said roof truss structure having a curved top chord and a straight bottom chord with struts and ties connecting said top and bottom chords together in a truss configuration, each said roof truss structure having a first end and a second end;

a support means for said framework, said support means consisting of a first support system and a second support system, said first support system consisting of a double "U" shaped channel means, said double "U" shaped channel means being affixed to said first end of each said roof truss structure along a first side of said array, said double "U" shaped channel means being affixed to and supported by an adjacent structure means at an elevation above the elevation of said second end of each said roof truss structure, said second support system consisting of an "E" shaped beam means, said "E" shaped beam means being affixed to said second end of each said roof truss structure along a second side of said array, said "E" shaped beam means being affixed to and supported by a plurality of post-like columns, the elevation of said "E" shaped beam being lower than said elevation of said double "U" shaped channel means, thereby causing said top chords of said plurality of roof truss structures to have a continuous descending slope toward said "E" shaped beam means;

a cover means over said framework, said cover means consisting of a plurality of panels configured in a flattened hill and valley contour, said panels having a first end and a second end, said first end of said panels being inserted in an uppermost "U" of said double "U" shaped channel means and being affixed therein, said second end of said panels being affixed to the uppermost surface of said "E" shaped beam with a short overhang;

an insulating means, said insulating means being rigid and of a flat sheet-like configuration, said insulating means having a first end and a second end, said insulating means being inserted between said cover means and said framework, said first end of said insulating means being inserted in the lowermost "U" of said double "U" shaped channel means, said second end of said insulating means being inserted in the uppermost opening of said "E" shaped beam means, said insulating means having a continuous air space between the upper surface thereof and the underside of said cover means, and a continuous air space between the underside of said insulating means and the topmost side of each said roof truss structure, said air spaces providing a blocking means to the transmission of heat and cold by conduction.

2. The thermalized awning as recited in claim 1, and additionally, a sealing means between said double "U" shaped channel and said adjacent structure to which said double "U" shaped channel is attached.

3. The thermalized awning as recited in claim 1, and additionally, a rubber seal between said double "U" shaped channel and said cover means.

* * * * *